US007836962B2

(12) United States Patent
Fagley, IV et al.

(10) Patent No.: US 7,836,962 B2
(45) Date of Patent: Nov. 23, 2010

(54) METHODS AND APPARATUS FOR A DOWNHOLE TOOL

(75) Inventors: Walter Stone Thomas Fagley, IV, Katy, TX (US); Gary Duron Ingram, Richmond, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/058,368

(22) Filed: Mar. 28, 2008

(65) Prior Publication Data

US 2009/0242211 A1 Oct. 1, 2009

(51) Int. Cl.
*E21B 33/12* (2006.01)

(52) U.S. Cl. ..... 166/387; 166/120

(58) Field of Classification Search ..... 166/120, 166/387

See application file for complete search history.

(56) References Cited

U.S. PATENT DOCUMENTS

| | | | | |
|---|---|---|---|---|
| 3,282,342 | A * | 11/1966 | Mott | 166/120 |
| 3,426,846 | A * | 2/1969 | Young | 166/129 |
| 3,520,360 | A * | 7/1970 | Kisling | 166/123 |
| 3,853,177 | A * | 12/1974 | Mott | 166/244.1 |
| 4,519,414 | A | 5/1985 | Anaya | |
| 4,527,415 | A | 7/1985 | Chabat-Courrede | |
| 4,589,440 | A | 5/1986 | Panet | |
| 4,705,259 | A | 11/1987 | Dolhen et al. | |
| 4,756,334 | A | 7/1988 | Panet et al. | |
| 4,791,992 | A * | 12/1988 | Greenlee et al. | 166/387 |
| 4,834,175 | A * | 5/1989 | Ross et al. | 166/120 |
| 5,597,040 | A | 1/1997 | Stout et al. | |
| 6,095,249 | A | 8/2000 | McGarian et al. | |
| 6,364,017 | B1 | 4/2002 | Stout et al. | |
| 6,523,856 | B2 * | 2/2003 | Braun et al. | 280/733 |
| 6,601,648 | B2 | 8/2003 | Ebinger | |
| 6,651,749 | B1 * | 11/2003 | Kilgore | 166/387 |
| 6,695,057 | B2 | 2/2004 | Ingram et al. | |
| 6,776,238 | B2 | 8/2004 | Dusterhoft et al. | |
| 6,883,610 | B2 | 4/2005 | Depiak | |
| 7,055,598 | B2 | 6/2006 | Ross et al. | |
| 7,114,558 | B2 * | 10/2006 | Hoffman et al. | 166/126 |

(Continued)

FOREIGN PATENT DOCUMENTS

| | | |
|---|---|---|
| GB | 2 130 274 | 5/1984 |

(Continued)

OTHER PUBLICATIONS

EP Search Report, Application No. 09156529.1-2315, dated Jul. 14, 2009.

*Primary Examiner*—William P Neuder
*Assistant Examiner*—Yong-Suk Ro
(74) *Attorney, Agent, or Firm*—Patterson & Sheridan, LLP

(57) ABSTRACT

An apparatus and method for operating a packer and a fracture valve is shown. The packer may include a tubular mandrel having a longitudinal bore with an annular packing element and a first piston disposed around the mandrel, wherein the first piston is operable to set the packing element, and a second piston operable to isolate fluid communication between the first piston and the mandrel bore. The fracture valve may include a tubular mandrel having a longitudinal bore and a port, a piston operable to close fluid communication between the bore and the port, and a latch disposed between the piston and the mandrel operable to resist movement of the piston.

34 Claims, 8 Drawing Sheets

U.S. PATENT DOCUMENTS

| | | | | |
|---|---|---|---|---|
| 7,134,488 | B2 | 11/2006 | Tudor et al. | |
| 7,243,727 | B2 | 7/2007 | Tudor et al. | |
| 2002/0074134 | A1 * | 6/2002 | Cook et al. | 166/383 |
| 2002/0121380 | A1 * | 9/2002 | Doane et al. | 166/382 |
| 2004/0007361 | A1 | 1/2004 | McGarian et al. | |
| 2004/0069496 | A1 | 4/2004 | Hosie et al. | |
| 2004/0069504 | A1 * | 4/2004 | Krueger et al. | 166/387 |
| 2005/0211446 | A1 | 9/2005 | Ricalton et al. | |
| 2006/0124315 | A1 | 6/2006 | Frazier et al. | |
| 2006/0207763 | A1 | 9/2006 | Hofman | |
| 2006/0243440 | A1 | 11/2006 | Corbett et al. | |
| 2006/0278399 | A1 * | 12/2006 | Dwivedi et al. | 166/375 |

FOREIGN PATENT DOCUMENTS

| | | |
|---|---|---|
| GB | 2 400 870 | 8/2005 |

* cited by examiner

METHODS AND APPARATUS FOR A DOWNHOLE TOOL

BACKGROUND OF THE INVENTION

1. Field of the Invention

Embodiments of the present invention generally relate to downhole tools for a hydrocarbon wellbore. More particularly, this invention relates to a packer pressure control valve. More particularly still, this invention relates to a fracture valve with a latch mechanism and erosion resistant components.

2. Description of the Related Art

In the drilling of oil and gas wells, a wellbore is formed using a drill bit that is urged downwardly at a lower end of a drill string. When the well is drilled to a first designated depth, a first string of casing is run into the wellbore. The first string of casing is hung from the surface, and then cement is circulated into the annulus behind the casing. Typically, the well is drilled to a second designated depth after the first string of casing is set in the wellbore. A second string of casing, or liner, is run into the wellbore to the second designated depth. This process may be repeated with additional liner strings until the well has been drilled to total depth. In this manner, wells are typically formed with two or more strings of casing having an ever-decreasing diameter.

After the wellbore has been drilled and the casing has been placed, it may be desirable to provide a flow path for hydrocarbons from the surrounding formation into the newly formed wellbore. Perforations may be shot through the liner string at a depth which equates to the anticipated depth of hydrocarbons. In many instances, either before or after production has begun, it is desirable to inject a treating fluid into the surrounding formation at particular depths. Such a depth is sometimes referred to as "an area of interest" in a formation. Various treating fluids are known, such as acids, polymers, and fracturing fluids.

In order to treat an area of interest, it is desirable to "straddle" the area of interest within the wellbore. This is typically done by "packing off" the wellbore above and below the area of interest. To accomplish this, a first packer having a packing element is set above the area of interest, and a second packer also having a packing element is set below the area of interest. Treating fluids can then be injected under pressure into the formation between the two set packers through a "frac valve." The "frac valve," however, must also be opened prior to injecting the treating fluids.

A variety of pack-off tools and fracture valves are available. Several such prior art tools and valves use a piston or pistons movable in response to hydraulic pressure in order to actuate the setting apparatus for the packing elements or opening apparatus for the fracture valve. However, debris or other material can block or clog the pistons and apparatus, inhibiting or preventing setting of the packing elements or opening of the fracture valve. Such debris can also prevent the un-setting or release of the packing elements or the closing of the valve. This is particularly true during fracturing operations, or "frac jobs," which utilize sand or granular aggregate as part of the formation treatment fluid. Further, the treating fluids may cause massive erosion of the fracture valve components, such as the valve ports, which may result in disruptive pressure drops across the tools.

Therefore, there is a need for an improved pack-off tool and fracture valve.

SUMMARY OF THE INVENTION

The present invention relates to a packer that includes a pressure control valve. The present invention also relates to a fracture valve that includes an apparatus to control the opening of the valve and erosion resistant components. The present invention may include an upper packer, a lower packer, and a fracture valve disposed between the two packers.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to methods and apparatus of a downhole tool. In one aspect, the downhole tool includes a packer. In a further aspect the downhole tool includes fracture valve. As set forth herein, the invention will be described as it relates to the packer, the fracture valve, and a straddle system including two packers and a fracture valve. It is to be noted, however, that aspects of the packer are not limited to use with the fracture valve or the straddle system, but are equally applicable for use with other types of downhole tools. For example, one or more of the packers may be used with a production tubing string or in a straddle system with a conventional fracture valve. It is to be further noted, however, that aspects of the fracture valve are not limited to use with the packer or the straddle system, but are equally applicable for use with other types of downhole tools. For example, the fracture valve may be used in a straddle system with conventional packers. To better understand the novelty of the apparatus of the present invention and the methods of use thereof, reference is hereafter made to the accompanying drawings.

Figure 1:
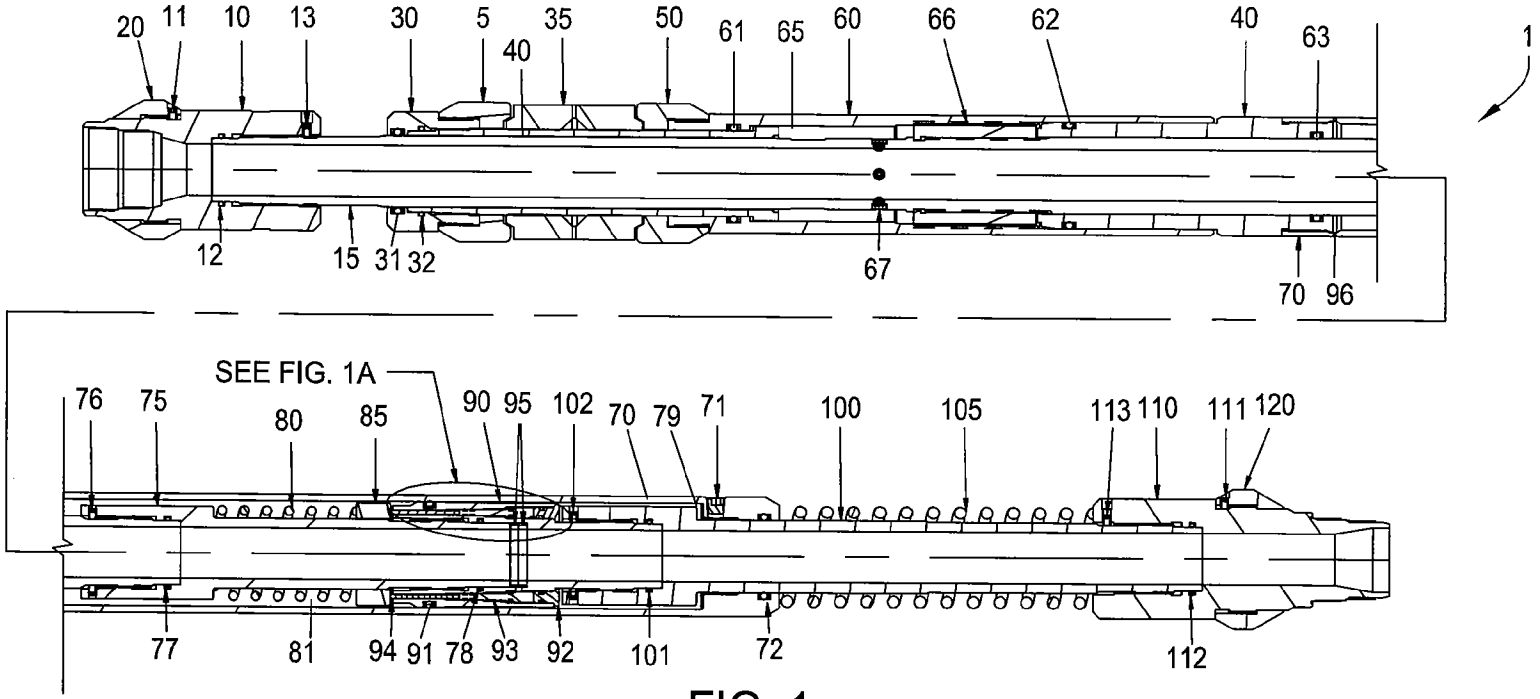
FIG. 1 is a cross-sectional view of a hydraulic packer according to one embodiment of the present invention.

FIG. 1 shows a cross-sectional view of a hydraulic packer 1 according to one embodiment of the present invention. The packer is seen in a run-in configuration. The packer 1 includes a packing element 35. The packing element 35 may be made of any suitable resilient material, including but not limited to any suitable elastomeric or polymeric material. Except for the seals and packing element 35, generally all components of the packer 1 may be made from a metal or alloy, such as steel or stainless steel, or combinations thereof. In an alternative embodiment, generally all components of the packer 1 may be made from a drillable material, such as a non-ferrous material, such as aluminum or brass. Actuation of the packing element 35 below a workstring (not shown) is accomplished, in one aspect, through the application of hydraulic pressure.

Figure 3:
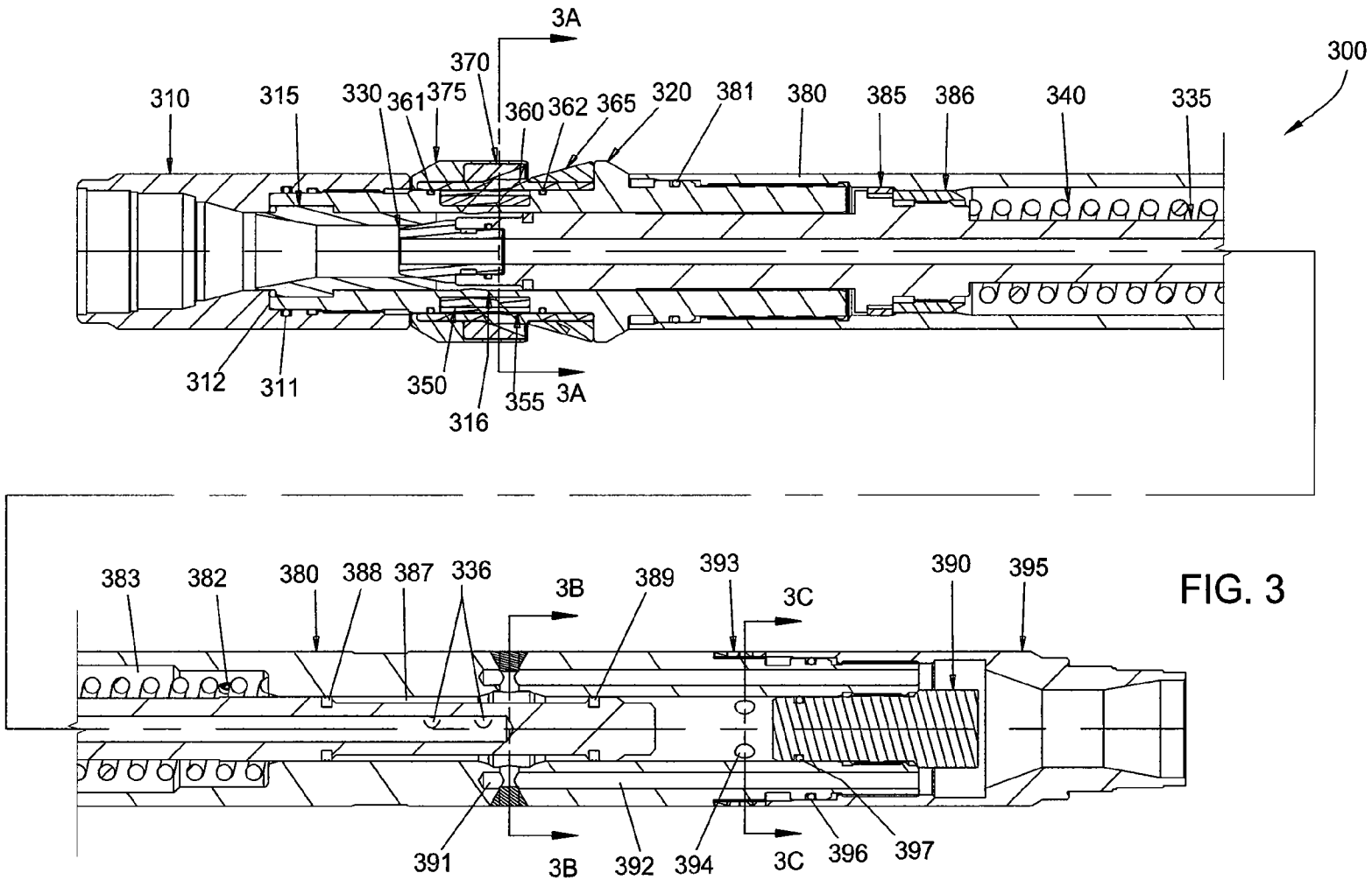
FIG. 3 is a cross-sectional view of a fracture valve according to one embodiment of the present invention.

Visible at the top of the packer 1 in FIG. 1 is a top sub 10. The top sub 10 is a tubular body having a flow bore therethrough. The top sub 10 is fashioned so that it may be connected at a top end to the workstring (not shown) or a fracture valve (as shown in FIG. 3). The top sub 10 is connected to a guide ring 20. The guide ring 20 defines a tubular body surrounding the top end of the top sub 10. The guide ring 20 may be used to help direct and protect the packer 1 as it is lowered into the wellbore. At a lower end, the top sub 10 is connected to a center mandrel 15. The center mandrel 15 defines a tubular body having a flow bore therethrough. The lower end of the top sub 10 surrounds a top end of the center mandrel 15. One or more set screws may be used to secure the various interfaces of the packer 1. For example, set screws 11 and 13 may be used to secure a top sub 10/guide ring 20 interface and a top sub 10/center mandrel 15 interface, respectively. One or more O-rings may be used to seal the various interfaces of the packer 1. In one embodiment, an o-ring 12 may be used to seal a top sub 10/center mandrel 15 interface.

The packer 1 shown in FIG. 1 also includes a gage ring retainer 30 and an upper piston 40. The gage ring retainer 30 and the upper piston 40 each generally define a cylindrical body and each surround a portion of the center mandrel 15. The gage ring retainer 30 is threadedly connected to and surrounds a top end of the upper piston 40. An o-ring 31 may be used to seal a gage ring retainer 30/center mandrel 15 interface. An o-ring 32 may be used to seal a gage ring retainer 30/upper piston 40 interface. Surrounding a bottom end of the gage ring retainer 30 and threadedly connected thereto is an upper gage ring 5. The upper gage ring 5 defines a tubular body and also surrounds a portion of the upper piston 40. At a bottom end, the upper gage ring 5 includes a retaining lip that mates with a corresponding retaining lip at a top end of the packing element 35. The lip of the upper gage ring 5 aids in forcing the extrusion of the packing element 35 outwardly into contact with the surrounding casing (not shown) when the packing element 35 is set.

At a bottom end, the packing element 35 comprises another retaining lip which corresponds with a retaining lip comprised on a top end of a lower gage ring 50. The lower gage ring 50 defines a tubular body and surrounds a portion of the upper piston 40. At a bottom end, the lower gage ring 50 surrounds and is threadedly connected to a top end of a case 60. The case 60 defines a tubular body which surrounds a portion of the upper piston 40. Between the case 60 and the center mandrel 15, the upper piston 40 defines a chamber 65. Corresponding to the chamber 65 is a filtered inlet port 67 disposed through a wall of the center mandrel 15.

Each filtered inlet port 67 is configured to allow fluid to flow through but to prevent the passage of particulates. The filtered inlet port 67 may include a set of slots. The slots may be substantially rectangular in shape and equally spaced around the entire circumference of the center mandrel 15 for each set of slots. The slots may be cut into the center mandrel 15 using a laser or electrical discharge machining (EDM), or other suitable methods, such as water jet cutting, fine blades, etc. The dimensions and number of slots may vary depending on the size of the particulates expected in the operational fluid. Other shapes can be used for the slots, such as triangles, ellipses, squares, and circles. Other manufacturing techniques may be used to form the filtered inlet port 67, such as the arrangement of powdered metal screens or the manufacture of sintered powdered metal sleeves with the non-flow areas of the sintered sleeves being made impervious to flow. The filtered inlet port 67 may comprise numerous other types of particulate filtering mediums.

Disposed within the chamber 65 are lugs 66. The lugs 66 may be annular plates which are threaded on both sides and may be used to assist with the assembly of the packer 1. The outer threads of the lugs 66 mate with threads disposed on an inner side of the case 60. The inner threads of the lugs 66 mate with threads disposed on an outer side of the center mandrel 15. The lugs 66 may further include a tongue disposed on a top end for mating with a groove disposed on the outer side of the center mandrel 15. Fluid may be allowed to flow around the lugs 66 within the chamber 65. O-rings 61, 62, and 63 may be used to seal a top end of the upper piston 40/case 60 interface, a middle portion of the upper piston 40/case 60 interface, and a bottom end of the upper piston 40/center mandrel 15 interface, respectively.

The bottom end of the upper piston 40 is threadedly connected to and partially disposed in a top end of a lower piston 70. The lower piston 70 defines a tubular body and surrounds the bottom end of the upper piston 40. The lower piston 70 also defines a low pressure chamber 81 which is vented to the annulus between the packer 1 and the wellbore via opening 96. The opening 96 may include a filtered communication between the chamber 81 and the annulus surrounding the packer 1. The bottom end of the center mandrel 15 continues through the upper piston 40 and ends within the lower piston 70. Connected to the bottom end of the center mandrel 15 is an upper spring mandrel 75. The upper spring mandrel 75 defines a tubular body having a flow bore therethrough and is disposed within the lower piston 70. A set screw 76 may be used to secure a center mandrel 15/upper spring mandrel 75 interface, and an o-ring 77 may be used to seal the same interface.

Abutting a shoulder on the outer diameter of the top end of the upper spring mandrel 75 is a top end of a first biasing member 80. Preferably, the first biasing member 80 comprises a spring, such as a wave spring. The spring 80 is disposed on the outside of the upper spring mandrel 75. A bottom end of the spring 80 abuts a top end of a spring spacer 85. The spring spacer 85 defines a tubular body that is slideably engageable with and disposed around the upper spring mandrel 75. The spring 80 presses the spring spacer 85 against a top end of a push rod 94 (discussed below) into an inner piston housing 90. Also, a bottom end of the upper spring mandrel 75 is threadedly connected to and partially disposed within the top end of the inner piston housing 90. The inner piston housing 90 defines a tubular body having a flow bore therethrough, and a cavity therethrough disposed adjacent to the flow bore in a top end of the inner piston housing. An o-ring 78 may be used to seal an upper spring mandrel 75/inner piston housing 90 interface.

Figure 1A:
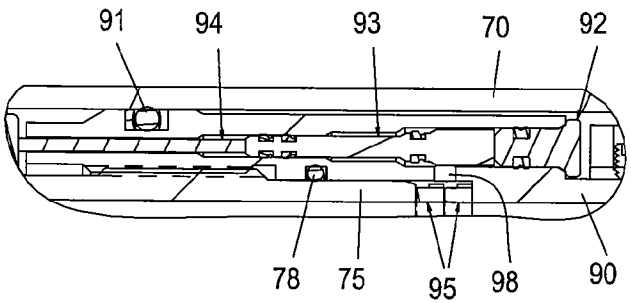
FIG. 1A is an enlarged view of an inner piston.

FIG. 1A shows an enlarged view of the inner piston 93. Referring to FIG. 1A, the inner piston housing 90 is disposed within and is sealingly engaged at its top end with the lower piston 70. An o-ring 91 may be used to seal an inner piston housing 90/lower piston 70 interface. Disposed in the cavity in the top end of the inner piston housing 90 are a plug 92, an inner piston 93, and the push rod 94, the operation of which will be more fully discussed with regard to FIGS. 2A-C. A port 98 is cut through an inner wall of the inner piston housing 90 that permits communication between the cavity and the flow bore of the packer 1. Fashioned adjacent to the port 98 is a filtered inlet port 95. The filtered inlet port 95 is configured to allow fluid to flow through but to prevent the passage of particulates. The filtered inlet port 95 may include a wafer screen, an EDM stack, or any other type of filtering medium that permits a filtered communication between the cavity of the inner piston housing 90 and the flow bore of the packer 1 through the port 98.

Figure 1B:
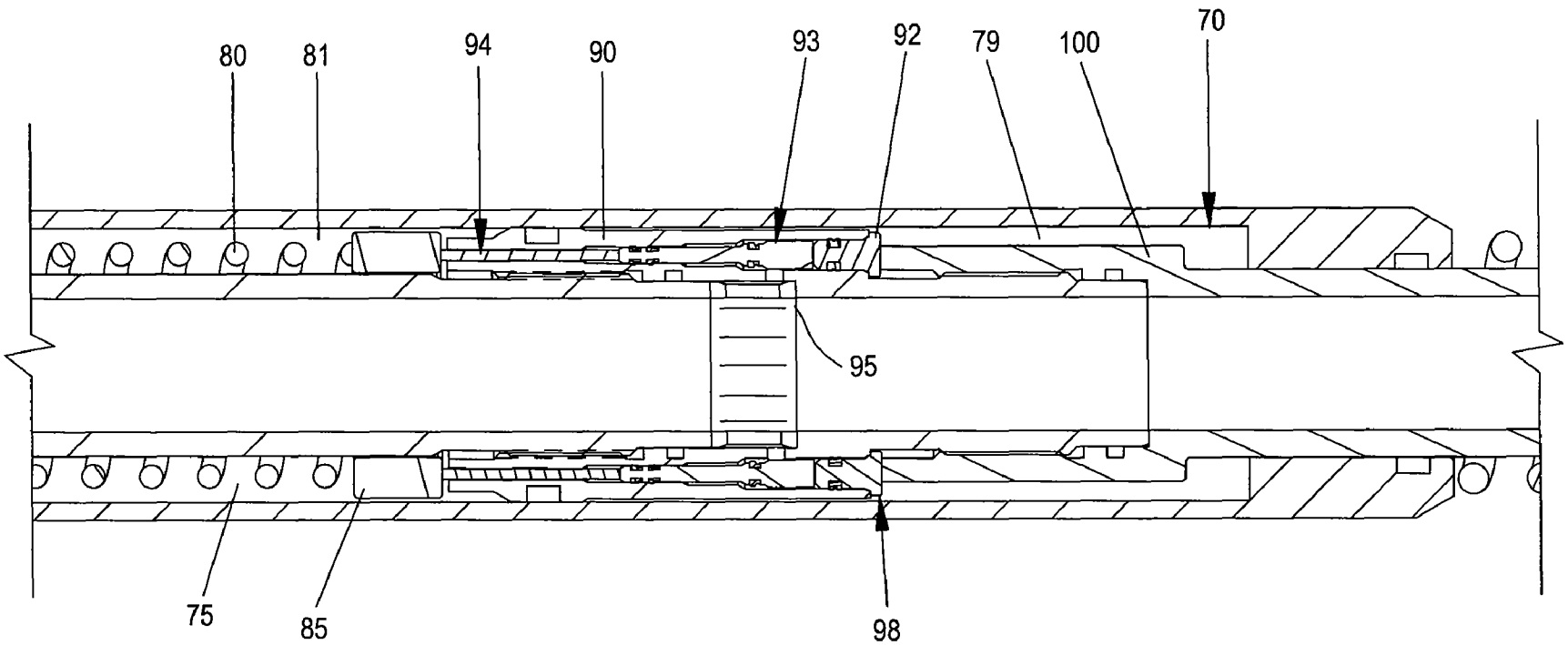
FIG. 1B is an enlarged view of the packer pistons.

FIG. 1B shows an enlarged view of the packer pistons, particularly the lower piston 70, the upper spring mandrel 75, the spring 80, the spring spacer 85, the inner piston arrangement, and a lower spring mandrel 100. Referring to FIG. 1B, during run-in of the packer 1, the spring 80 presses the spring spacer 85 against the push rod 94, which pushes the inner piston 93 into the cavity of the inner piston housing 90 and holds it in the run-in position. The spring 80 provides a resistance force that controls the pressure at which the inner piston 93 actuates to a closed position. The spring 80 also controls the pressure at which it pushes the push rod 94 and thus the inner piston 93 back into an open position.

Referring back to FIG. 1, the bottom end of the inner piston housing 90 is threadedly connected to and partially disposed in a top end of the lower spring mandrel 100. An o-ring 101 may be used to seal an inner piston housing 90/lower spring mandrel 100 interface and a set screw 102 may be used to secure the same interface. The lower spring mandrel 100 defines a tubular body having a flow bore therethrough. The top end of the lower spring mandrel 100 includes an enlarged outer diameter, creating a shoulder on the outer surface, which is disposed in the lower piston 70. The bottom end of the lower piston 70 has a reduced inner diameter, creating a shoulder on the inner surface of the piston. The two shoulders may seat against each other, preventing the top end of the lower spring mandrel 100 from being completely received through the throughbore of the lower piston 70 but allowing the lower spring mandrel body to project through the bottom of the lower piston 70. The lower piston 70 is slideably engaged with the lower spring mandrel 100. An o-ring 72 may be used to seal a lower spring mandrel 100/lower piston 70 interface.

A plug 71, formed in the lower piston 70, is disposed adjacent to a chamber 79 fashioned between the lower piston, the inner piston housing 90, and the top end of the lower spring mandrel 100. The plug 71 may be used to seal and/or flush the chamber 79. The plug 71 may be used for pressure testing the seals and testing for proper orientation of the inner piston housing 90 and its internal components.

Abutting the bottom end of the lower piston 70 is a top end of a second biasing member 105. The second biasing member 105 may include a spring. The spring 105 is disposed on the outside of the lower spring mandrel 100. The bottom end of the spring 105 abuts a top end of a bottom sub 110. The top end of the bottom sub 110 surrounds and is threadedly connected to the bottom end of the lower spring mandrel 100. The bottom sub 110 defines a tubular body having a flow bore therethrough. An o-ring 112 may be used to seal a lower spring mandrel 100/bottom sub 110 interface, and a set screw 113 may be used to secure the same interface. Like the top sub 10, the bottom sub 110 is connected to a guide ring 120. The guide ring 120 defines a tubular body surrounding the bottom sub 110. A bottom end of the bottom sub 110 is fashioned so that it may be connected to other downhole tools and/or members of the workstring, such as a fracture valve (as shown in FIG. 3).

The interaction between the packer and other downhole tools may be troublesome. For example, since the fracture valve is generally positioned between two packers, the packing elements may be exposed to the same amount of pressure necessary to open the fracture valve. If the fracture valve is hydraulically actuated like the packers, the opening pressure of the valve must exceed the setting pressure of the packing elements. The valve opening pressure may produce an excessive force on the packing elements, thereby damaging the packing elements and their sealing or functioning capacity. Other downhole tools that may require operating pressures in excess of the setting pressures of the packing elements may similarly subject the packing elements to such damaging forces. Therefore, the packer pistons as described herein may be used to protect the packing elements.

Figure 2A:
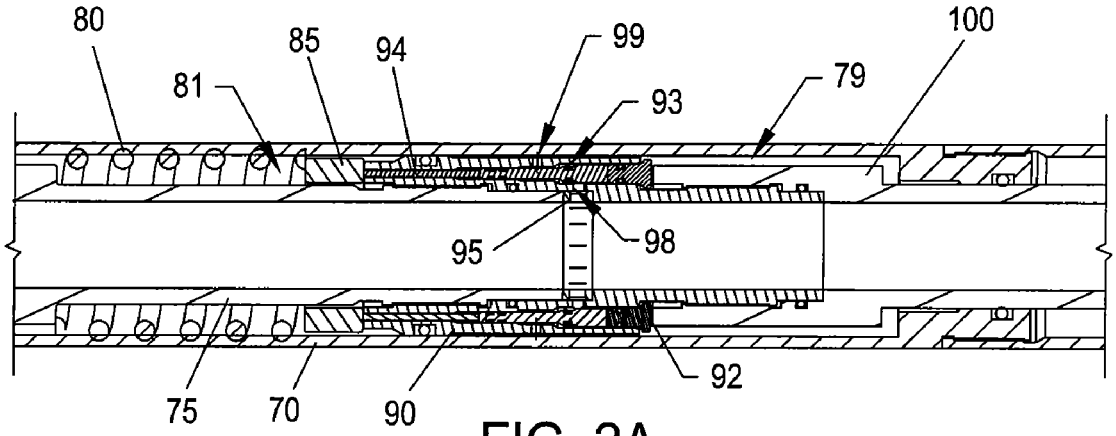
FIG. 2A shows the run-in position of the packer pistons.
Figure 2B:
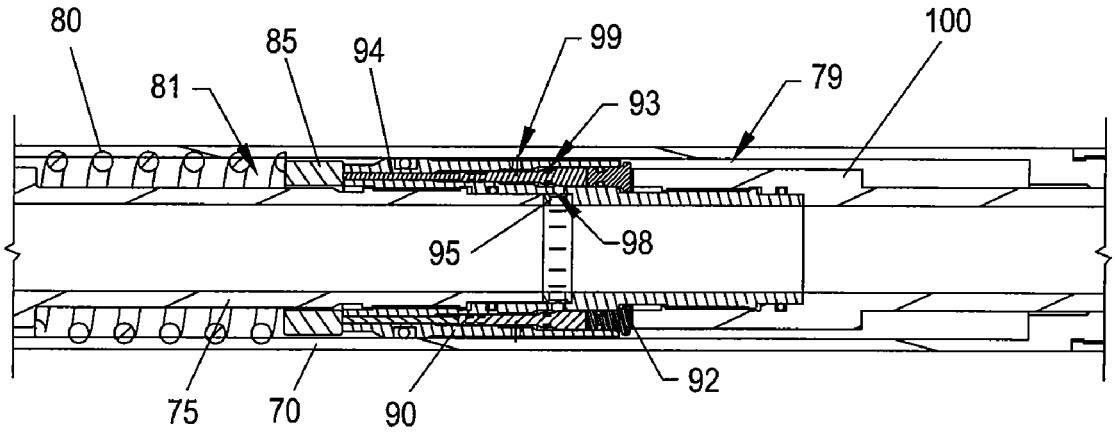
FIG. 2B shows the pack-off position of a lower piston.
Figure 2C:
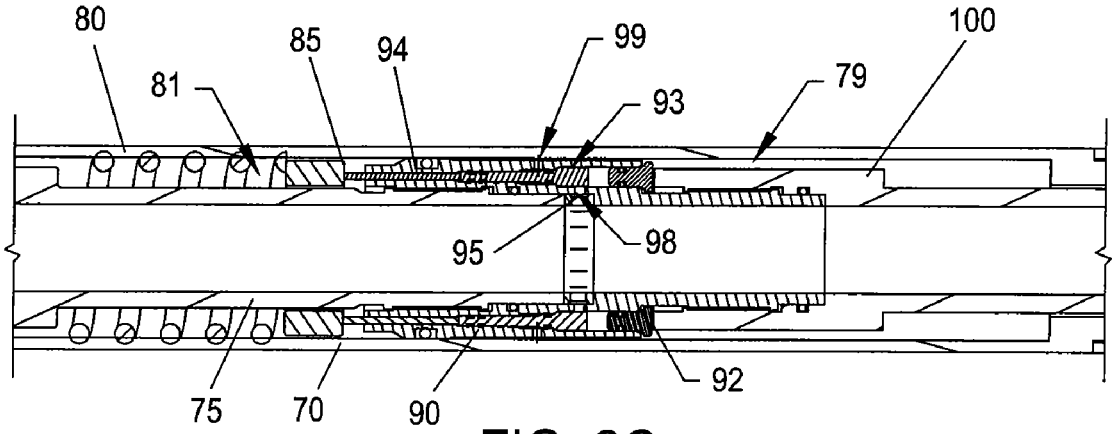
FIG. 2C shows the shut-off position of the inner piston.

FIGS. 2A-C display the operation of the packer pistons. FIG. 2A shows the run-in position of the pistons as the packer 1 is being lowered into a wellbore. Once the packer 1 is positioned in the wellbore, fluid pressure is pumped into the flow bore of the packer 1. Fluid pressure may be allowed to build-up in the flow bore of the packer 1 by a variety of means known by one of ordinary skill. As the fluid pressure reaches the filtered inlet port 95, it filters into the cavity in the inner piston housing 90, through the port 98. The cavity of the inner piston housing 90 is sealed at one end by the plug 92 and at the other end by the bottom end of the inner piston 93. Positioned between these two seal areas is a port 99 located in the outer wall of the inner piston housing 90 that communicates with the cavity and the chamber 79. The fluid pressure is allowed to travel around the inner piston 93 and enter the chamber 79 via the port 99.

FIG. 2B shows the pack-off position of the lower piston 70. As the fluid pressure builds and reaches a first pressure, the chamber 79 becomes pressurized enough to force the lower piston 70 in a downward direction along the lower spring mandrel 100 body. As can be seen in FIG. 1, as the lower piston 70 is forced in a downward direction, it pulls the upper piston 40 in a downward direction, thus contracting the gage ring retainer 30 and the upper gage ring 5, thereby compressing the packing element 35 outwardly into contact with the surrounding casing (not shown). Once the packing element 35 is set, the fluid pressure may continue to increase in the chamber 79, as well as in the cavity in the inner piston housing 90, if the fluid pressure increases in the flow bore of the packer 1. As will be described further, the inner piston arrangement may be used to address this increase in pressure.

FIG. 2C shows the shut-off position of the inner piston 93. The inner piston 93 and the push rod 94 are slideably engaged within the cavity of the inner piston housing 90. The inner piston 93 includes a tapered shoulder and a seal that may close communication between the cavity and the chamber 79, by sealing off the port 99 in the outer wall of the inner piston housing 90. As the fluid pressure continues to build in the chamber 79 and in the cavity in the inner piston housing 90, it will reach a second pressure that forces the inner piston 93 to move in an upward direction. As the inner piston 93 moves upward, it seals off communication to the port 99, which seals the pressure in the chamber 79. The inner piston 93 also forces the push rod against the spring 80, thereby displacing the spring spacer 85 and closing communication between the chamber 81 and the flow bore of the packer 1. After the inner piston 93 seals off communication from the flow bore of the packer 1, the fluid pressure may continue to build in the flow bore of the packer 1, but the piston force on the packing element 35 will not increase.

The shut-off position of the inner piston 93 protects the packing element 35 from being over-compressed. This protection also helps prevent a potential seal failure of the packing element 35 due to any excessive force caused by increased fluid pressure in the flow bore of the packer 1. This increased pressure can be used to actuate another downhole tool disposed below and/or above the packer 1, without damaging the packing element 35.

As the pressure is reduced in the flow bore of the packer 1, the pressure against the inner piston 93 in the cavity of the inner piston housing 90 will decrease. The spring 80 will force the spring spacer 85, the push rod 94, and the inner piston 93 in a downward direction, thus releasing the packing pressure in the chamber 79 to the flow bore of the packer 1, via the ports 98 and 99 in the cavity of the inner piston housing 90. As the packing pressure is released, the spring 105 will also force the lower piston 70 in an upward direction, retracting the upper piston 40, the gage ring retainer 30, and the upper gage ring 5, allowing the packing element 35 to unset. After the packing element 35 is unset, the packer 1 may be retrieved or re-positioned to another location in the wellbore.

As shown in FIGS. 2A-C, the packer 1 includes two plugs 92, inner pistons 93, and push rods 94, disposed in the inner piston housing 90. In an alternative example, one plug, piston, and rod may be disposed in the inner piston housing 90. In an alternative example, four plugs, pistons, and rods may be disposed in the inner piston housing 90. These components may be symmetrically disposed within the inner piston housing.

A first packer may be used above a downhole tool and a second packer may be used below the downhole tool. A plug can be positioned below the second packer to allow fluid pressure to develop inside of the flow bores of the two packers and the downhole tool positioned therebetween. Any means known by one of ordinary skill may be used to build up pressure between the two packers and the downhole tool. As the pressure builds, the first and second packers may be configured to set the packing elements at a first packing pressure. Once the packers are set, the inner pistons of the packers can be configured to shut-off communication to the packing pistons at a second pressure. The fluid pressure can then be increased to actuate the downhole tool without exerting any excessive piston force on the packing elements of the two packers.

A second assembly, including a lower piston, a lower spring mandrel, a spring, and an inner piston arrangement, can be incorporated as a series into the packer 1. This second assembly can be used in conjunction with the same piston assembly as described and shown in FIGS. 1B and 2A-C. With the two piston assemblies working in series, the increased piston area relating to the two lower pistons will permit the packer 1 to set at a lower pressure. Even at this lower setting pressure, the inner pistons can be configured to shut-off communication to the flow bore of the packer and maintain the packer setting pressure. As stated above, the fluid pressure in the flow bore of the packer may then be increased to actuate another downhole tool while the inner pistons protect the packing element from any excessive force and damage.

FIG. 3 shows a cross-sectional view of a fracture valve 300 according to one embodiment of the present invention. The fracture valve 300 is seen in a run-in configuration. Except for the seals, all components of the fracture valve 300 may be made from a ceramic, a metal, an alloy, or combinations thereof. Visible at the top of the fracture valve 300 is a top sub 310. The top sub 310 is a generally cylindrical body having a flow bore therethrough. The flow bore may include a nozzle shaped entrance. The top sub 310 is fashioned so that it may be connected at a top end to a workstring (not shown) or a packer (as shown in FIG. 1).

At a bottom end, the top sub 310 surrounds and is threadedly connected to a top end of an insert housing 320. The insert housing 320 defines a tubular body having a bore therethrough. Set screws may optionally be used to prevent unthreading of the top sub 310 from the insert housing 320. An o-ring 311 may be used to seal a top sub 310/insert housing 320 interface. The top end of the insert housing 320 surrounds and is connected to a seal sleeve 315. The seal sleeve 315 defines a tubular body with a flow bore therethrough. The seal sleeve 315 is disposed within the top of the insert housing 320 so that the flow bore of the top sub 310 communicates directly into the flow bore of the seal sleeve 315, which may help prevent erosion of the insert housing 320. An o-ring 312 may be used to seal a top sub 310/seal sleeve 315/insert housing 320 interface.

A flow diverter 330 is adapted to sealingly engage with the seal sleeve 315 within the insert housing 320. The flow diverter defines a tubular body with a cone-shaped nose and a flow bore therethrough. In one embodiment, an orifice such as a hole may be located above the flow diverter 330, or alternatively through the diverter, to provide a small leak path from the inside of the fracture valve 300 to the annulus surrounding the valve, while the valve is in a closed position. This leak path may alter the flow rate at which the fracture valve 300 will open. The leak path may also facilitate blank pipe testing of the fracture valve 300 by allowing fluid to exit from and return into the flow bore of the valve. The bottom end of the flow diverter 330 is connected to a top end of a center piston 335. The center piston 335 defines a tubular body with a flow bore therethrough. A set screw may be used to secure the flow diverter 330 to the center piston 335. An O-ring 316 may be used to seal a flow diverter 330/center piston 335 interface.

The top end of the center piston 335 is slideably positioned within the bore of the insert housing 320. Abutting a lower shoulder formed in the middle of the center piston 335 is a top end of a biasing member 340. The biasing member may include a spring. The spring biases the center piston 335 in an upward direction and may act as a return spring when the pressure in the fracture valve 300 is released.

A latch 385, which will be more fully discussed below, surrounding the middle of the center piston 335 may help keep the piston positioned in a manner that allows the flow diverter 330 to sealingly engage with the seal sleeve 315. As this occurs, the flow bore of the seal sleeve 315 communicates directly into the flow bore of the flow diverter 330, which communicates directly into the flow bore of the center piston 335.

The insert housing 320 has a recess positioned in its outer surface that contains an angled port through the insert housing 320 wall that communicates with the bore of the housing. The angled port may be located just below the bottom end of the seal sleeve 315. Disposed within the recess, adjacent to the port, is a first insert 350. The first insert 350 may have an angled port in the wall of the insert that communicates with the angled port in the insert housing 320. Surrounding the first insert 350 is a second insert 355. The second insert may also have an angled port in the wall of the insert that communicates with the angled port in the insert housing 320. The second insert 355 and the first insert 350 are both disposed in the recess of the insert housing 320 and may be removable.

Figure 3C:
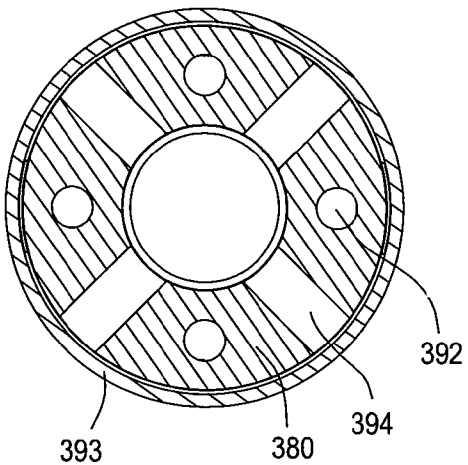
FIG. 3C is a top cross-sectional view of the fracture valve.
Figure 3B:
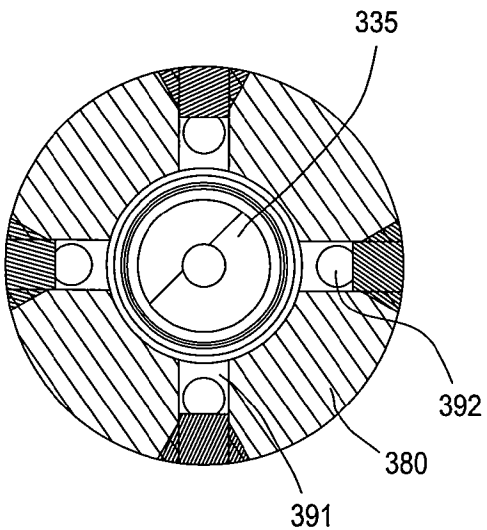
FIG. 3B is a top cross-sectional view of the fracture valve.
Figure 3A:
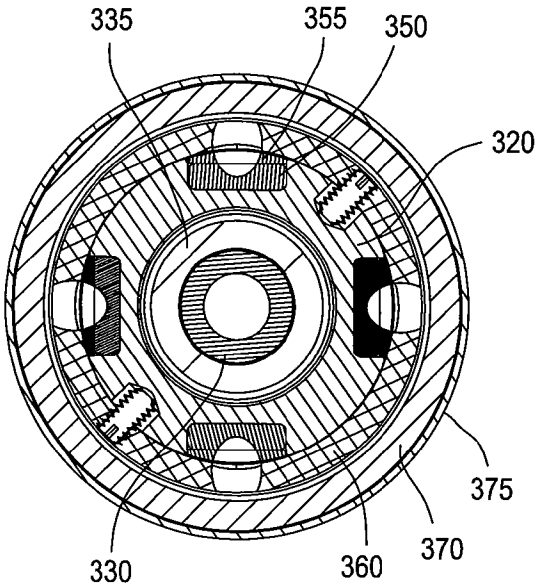
FIG. 3A is a top cross-sectional view of the fracture valve.

An insert retaining ring 360 may be used to retain the first and second inserts within the recess of the insert housing 320. The insert retaining ring 360 may define a tubular body with a bore therethrough and include an angled port in the wall of the retaining ring that communicates with the angled ports in the first and second inserts. The ends of the insert retaining ring 360 may extend beyond the recess in the insert housing 320. The bottom end of the insert retaining ring 360 abuts against a shoulder in the middle of the insert housing 320 body. O-rings 361 and 362 may be used to seal insert housing 320/insert retaining ring 360 interfaces. A set screw may be used to secure the insert retaining ring 360 to the insert housing 320 as shown in FIG. 3A, which shows a top cross-sectional view of the fracture valve 300 as just described above. As shown in FIG. 3A, there may be four insert arrangements disposed in the fracture valve 300. Also, the insert retaining ring 360 may comprise of two hemi-cylindrical sections with angled ports therethrough, respectively, that communicate with the insert arrangement.

A flow diffuser 365 surrounds the bottom end of the insert retaining ring 360 and abuts against the shoulder of the insert housing 320. The flow diffuser 365 has an angled outer surface that protrudes outwardly from its top end to its bottom end. The outer surface of the flow diffuser 365 is adapted to receive and direct fluid from the flow bore of the fracture valve 300 into the annulus of the wellbore surrounding the valve. The flow diffuser 365 may be used to help protect the outer housings of the fracture valve 300 from damage by the high pressure injection of fracture fluid.

A flow deflector 370 surrounds a part of the top end of the insert retaining ring 360 just above the angled port in the insert retaining ring 360 wall. The flow deflector 370 has an angled inner surface that extends over the angled port in the insert retaining ring 360 wall. The inner surface of the flow deflector directs flow in a downward direction, directly onto the outer surface of the flow diffuser 365. The flow deflector 370 may be used to disrupt the high pressure injection of fracture fluid exiting the fracture valve 300 from damaging the casing surrounding the valve.

A shield sleeve 375 surrounds the flow deflector 370, as well as the top end of the insert retaining ring 360. The top end of the shield sleeve 375 has a lip that extends over and seats on the top of the insert retaining ring 360. The lip of the shield sleeve 375 is located directly below the bottom end of the top sub 310. The shield sleeve may be used to protect and retain the flow deflector 370 against the insert retaining ring 360.

Connected to and surrounding the bottom end of the insert housing 320 is a lower housing 380. An o-ring 381 may be used to seal a insert housing 320/lower housing 380 interface and a set screw may also be used to secure the same interface. The lower housing includes a chamber 383 that communicates to the annulus surrounding the fracture valve via an opening 382. The opening 382 may include a filter to prevent fluid particles from entering the chamber 383. Also disposed within the chamber 383 of the lower housing 380, the middle of the center piston 335 has a flanged section that is located just below the bottom of the insert housing 320.

The latch 385 is positioned between the center piston 335 and the lower housing 380. The latch may include a c-ring. In an alternative embodiment, the latch 385 may include a collet. The c-ring 385 may be seated below the flanged section of the center piston 335 and secured at its bottom end by a c-ring retainer 386. The c-ring retainer 386 is threadedly connected to the center piston 335 and longitudinally secures the c-ring 385 to the center piston. The c-ring 385 also abuts a tapered shoulder that forms a groove on the inner surface of the lower housing 380. In one embodiment, the tapered shoulder may have an angle ranging from twenty to eighty degrees. When the c-ring 385 is positioned above the tapered shoulder of the lower housing 380, it sealingly engages the flow diverter 330 with the seal sleeve 315.

As pressure is directed into the flow bore of the fracture valve 300 and the chamber 383 of the lower housing 380, the c-ring 308 keeps the valve closed as it abuts against the tapered shoulder. The angle of the tapered shoulder controls the amount of pressure needed to open the valve. As the pressure is increased, the center piston 335 may be directed in a downward direction with a sufficient amount of force to allow the c-ring 385 to radially compress against the tapered shoulder and allow the mandrel to slide in a downward direction against the spring 340. The upper shoulder of the center piston 335 pushes the c-ring along the groove on the inner surface of the lower housing 380, and the c-ring 385 is allowed to radially expand as it exits the groove and travels down a tapered bevel on the inner surface of the lower housing. In one embodiment, the tapered bevel may have an angle ranging from five to 20 degrees. The angle of the tapered bevel controls the amount of pressure necessary to close the valve. A lower degree angle permits the valve to close at a lower pressure than the opening pressure. The tapered bevel may also prevent the valve from closing in the event of a pressure drop sufficient enough to begin to allow the spring to bias the valve into a closed position. In an alternative embodiment, the latch 385 may be disposed on the lower housing 380 and the tapered shoulder and bevel may be formed on the piston body.

The fracture valve 300 may be in a fully open position when it exits the groove on the inner surface of the lower housing 380 down the tapered bevel. At this point, the flow diverter 330 may be held out of the flow path of the injected fluid, which helps eliminate any "chatter" that the valve may experience. Chatter is an effect caused by pressure building and pushing the diverter open, the sudden pressure drop due to the increased flow area, and the spring pushing the diverter back into the flow and into a closed position. The c-ring/groove/tapered shoulder arrangement may allow a sufficient amount of pressure to build to allow the center piston 335 to force the c-ring over the shoulder and along the length of the groove, fully opening the valve. The tapered bevel may then help keep the valve open and hold the flow diverter 330 away from the direct path of the higher pressure injected fluid flow, to protect it from excessive erosion.

The bottom end of the center piston 335 and the lower housing 380 define a chamber 387. The chamber 387 may be sealed at its ends by seals 388 and 389. The flow bore of the center piston 335 communicates with the chamber 387 via openings 336 in the wall of the piston, which are disposed between the seals 388 and 389. Corresponding to the chamber 387 is a port 391 disposed through the wall of the lower housing 380. The port 391 may include a filter, such as a safety screen, to prevent particles from exiting into the annulus surrounding the fracture valve 300. Communicating to the port 391 is a by-pass port 392 that is disposed in the wall of the lower housing 380. The by-pass port 392 travels from the port 391 to the bottom end of the lower housing 380, exiting into a flow bore of a bottom sub 395. The by-pass port 392 provides a path for the particles in the fluid to pass through, preventing build up within the fracture valve 300. Also, the by-pass port 392 allows pressure to communicate with a tool disposed below the fracture valve 300, such as a packer as described above. FIG. 3B shows a top cross-sectional view of the fracture valve 300 as just described above. As shown in FIG. 3B, there may be four ports 391 and four by-pass ports 392 disposed in the lower housing 380 body, although any desired number of ports may be used.

The bottom sub 395 is a generally cylindrical body. At a top end, the bottom sub 395 surrounds and is connected to the bottom end of the lower housing 380. Set screws, or other securing mechanisms, may be used to prevent unthreading of the bottom sub 395 from the lower housing 380. An o-ring 396 may be used to seal a bottom sub 395/lower housing 380 interface. The flow bore of the bottom sub 395 may include a nozzle shaped exit. At a bottom end, the bottom sub 395 is fashioned so that it may be connected to the workstring or another downhole tool, such as a packer (as displayed in FIG. 1).

A lower housing plug 390 is threadedly connected into the throughbore of the lower housing 380 at its bottom end. An o-ring 397 may be used to seal a plug 390/lower housing 380 interface. Located above the plug 390 are ports 394 that are disposed through the wall of the lower housing 380. The ports 394 communicate a portion of the throughbore of the lower housing, i.e. located between the bottom end of the center piston 335 and the top end of the lower housing plug 390, with the annulus surrounding the exterior of the fracture valve 300. The port 391 may be fitted with a filter 393 that permits a filtered communication between the annulus and the throughbore of the lower housing 380. The filter 393 may include a screen or an EDM stack as described herein with respect to the packer embodiments. FIG. 3C shows a top cross sectional view of the fracture valve 300. As shown in FIG. 3C, there may be are four ports 394 disposed in the lower housing 380 body.

Figure 4:
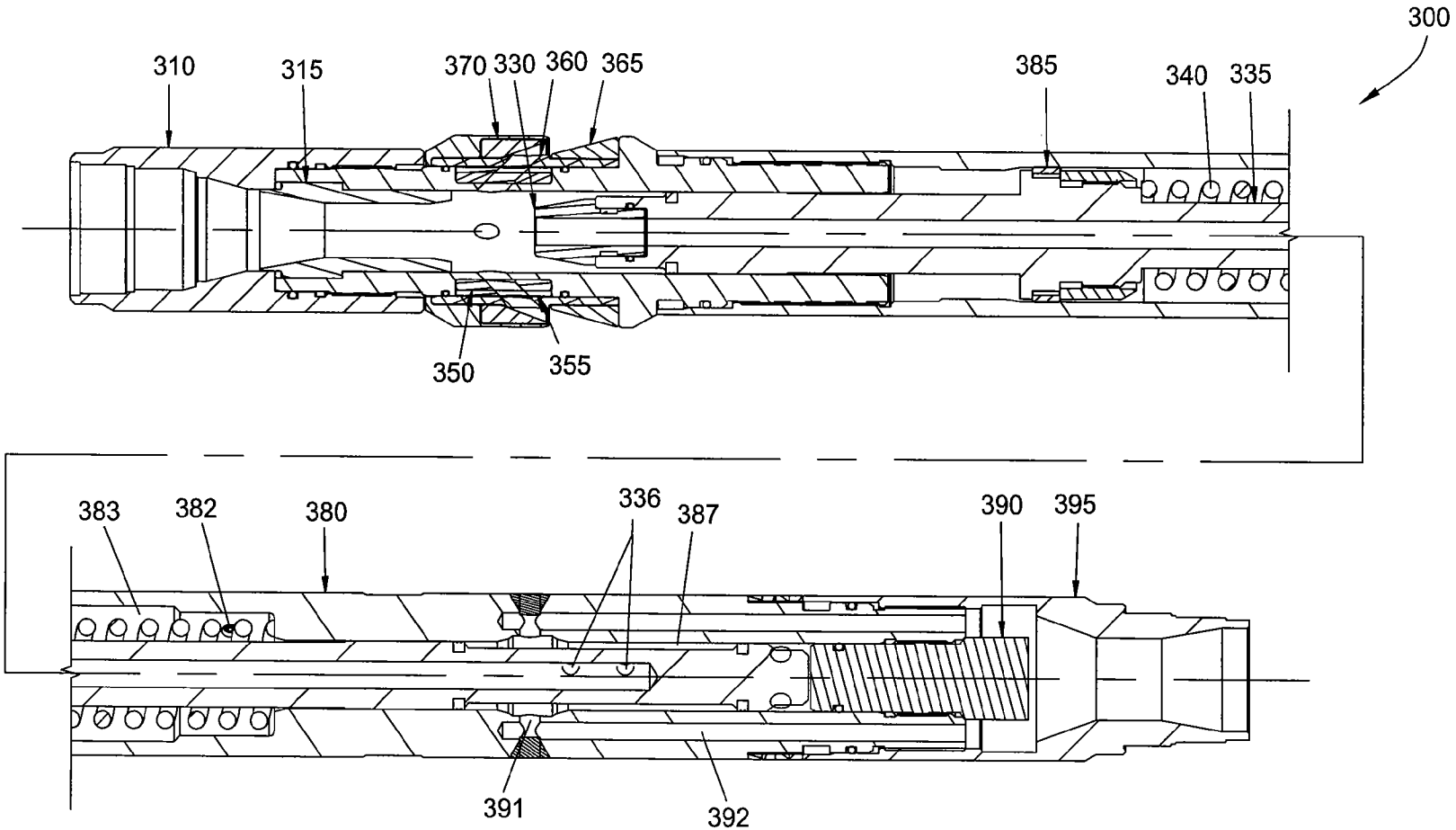
FIG. 4 is a cross-sectional view of the fracture valve in an open position.

FIG. 4 shows a cross-sectional view of the fracture valve 300 in an open position. When the requisite pressure is produced to force the c-ring 385 over the tapered shoulder within the lower housing 380, the flow diverter 330 and the center piston 335 slide in a downward direction. As the flow diverter 330 releases its sealed engagement with the seal sleeve 315, the fluid flow is directed to the annulus surrounding the fracture valve 300 through the ports as described above. The bottom end of the center piston 335 may abut against the lower housing plug 390 and the openings 336, the ports 391, and the by-pass ports 392 may still maintain communication with each other.

Figure 5:
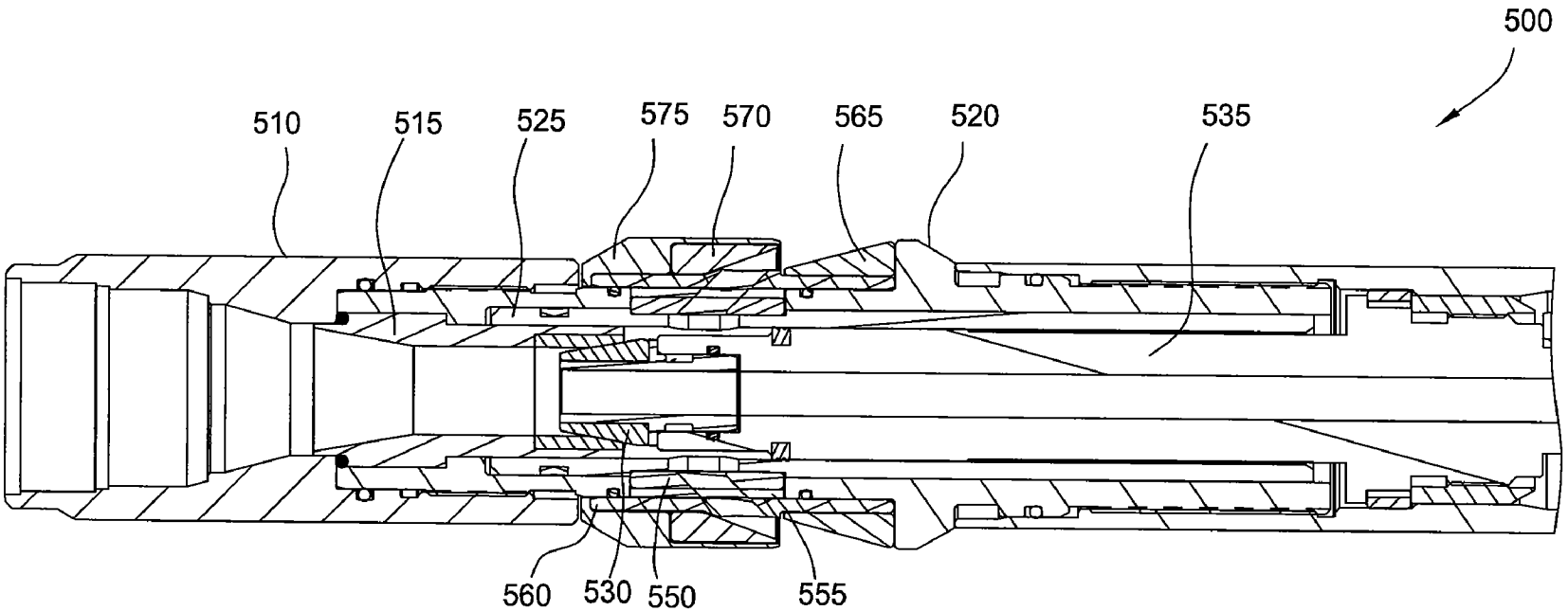
FIG. 5 is a cross-sectional view of a fracture valve according to one embodiment of the present invention.

FIG. 5 shows a cross-sectional view of a fracture valve 500 according to one embodiment of the present invention. Many of the components of the fracture valve 500, specifically a top sub 510, a seal sleeve 515, a insert housing 520, a flow diverter 530, a center piston 535, a shield sleeve 575, a flow deflector 570, a flow diffuser 565, a insert retaining ring 560, a second insert 555, and a first insert 550, are operatively situated as with the fracture valve 300. The fracture valve 500 may also include a few modifications.

The bottom end of the flow bore of the seal sleeve 515 may be formed from, coated with, and/or bonded with an erosion resistant material, such as a ceramic, such as a carbide, such as tungsten carbide, to help protect it from wear by any fluid that is injected into the fracture valve 500. Similarly, the nose of the flow diverter 530 may be formed from, coated with, and/or bonded with an erosion resistant material, such as a ceramic, such as a carbide, such as tungsten carbide, to help protect it from wear by any fluid that is injected into the fracture valve 500. When the fracture valve 500 is closed, the coated nose of the flow diverter 530 is sealingly engaged with the coated flow bore of the seal sleeve 515. Similarly, the ports of the first insert 550 and the second insert 555 may be formed from, coated with, and/or bonded with an erosion resistant material, such as a ceramic, such as a carbide, such as tungsten carbide, to help protect them from wear by any fluid that is injected into the fracture valve 500. The material of the inserts may help distribute any force/load that may be enacted upon these components. The inserts may also be adapted to be removable.

The shield sleeve 575, the flow deflector 570, the flow diffuser 565, and the insert retaining ring 560 may be disposed around the insert housing 520 in a similar manner as with the fracture valve 300. The insert housing 520 may also have a port disposed through the wall of the housing in which the first insert 550 and the second insert 555 are located. In addition, the first insert 550 may be seated in a small recess on the outer surface of a liner 525 adjacent to the insert housing 520. The liner 525 may define a tubular body with a bore therethrough that may be surrounded by the insert housing 520. The center piston 535 may be disposed within the bore of the liner 525 and may be slideably and sealingly engaged with the inner surface of the liner. The top end of the liner 525 surrounds the bottom end of the seal sleeve 515. Finally, the liner 525 may have a port adjacent to the first insert 550 that communicates with the angled ports in the first and second inserts 550 and 555, respectively.

When the fracture valve 500 begins to open, the injected fluid is first received by the liner 525 and subsequently directed to the annulus surrounding the fracture valve 500 through the insert arrangement. The liner 525 may be formed from, coated with, and/or bonded with an erosion resistant material, such as a ceramic, such as a carbide, such as tungsten carbide, to help protect itself, as well as, the insert housing 520, the first insert 550, and the second insert 555 from wear by the injected fluid.

A method of operation will now be discussed. An assembly that includes an upper packer, such as the packer shown in FIG. 1, a lower packer, such as the packer shown in FIG. 1 but modified with two piston arrangements in a series, and a fracture valve, such as the fracture valve shown in FIGS. 3 and 5, disposed between the top and bottom packers may be lowered into a wellbore on a workstring, such as a string of coiled tubing. The workstring may be any suitable tubular useful for running tools into a wellbore, including but not limited to jointed tubing, coiled tubing, and drill pipe. Additional tools or pipes, such as an unloader (not shown) or a spacer pipe (not shown), may be used with the assembly on the workstring between, above, and/or below the packers and/or the valve. Either of the packers may be oriented right-side up or upside down and/or the top subs and the bottom subs of either packer may be exchanged when positioned on the workstring.

Figure 6:
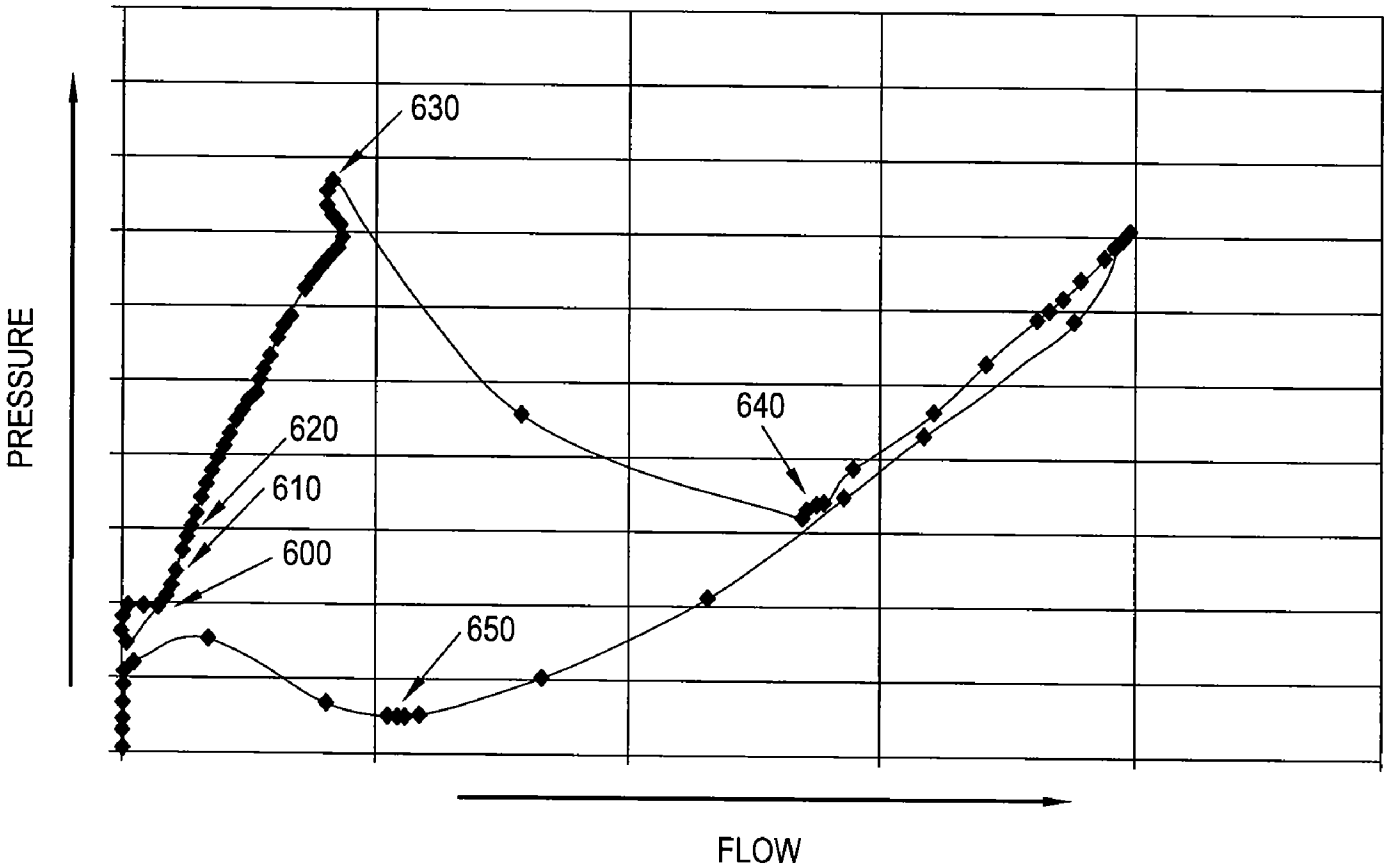
FIG. 6 is a Pressure v Flow Rate chart.

FIG. 6 shows a Pressure v. Flow Rate chart that tracks the pressure and flow rate within a fracture valve as described in FIGS. 3 and 5 during a fracturing operation. The arrows point in a direction signifying an increase in the pressure and flow rate respectively. The reference numerals highlight particular events that occur during the fracturing operation, which will be described below.

Referring to FIG. 6, the assembly is positioned adjacent an area of interest, such as perforations within a casing string. Once the assembly has been located at the desired depth in the wellbore, a fluid pressure is introduced into the assembly. Fluid is injected into the assembly at a first flow rate and pressure, indicated by the fracture valve c-ring seated on the tapered shoulder of the lower housing shown on the chart at 600.

The fluid is then injected at a second flow rate and pressure, indicated by the lower packer being set shown on the chart at 610. At this point, the inner pistons of the lower packer may also be adapted to shut-off communication from the flow bore of the lower packer so that the packing element will not be subjected to any further increased pressure and will be maintained in a setting position. The lower packer may be adapted to set at a lower flow rate and pressure due to the increased piston area incorporated into the lower packer by the addition of a second piston arrangement.

The fluid is then injected at a third flow rate and pressure, indicated by the upper packer being set shown on the chart at 620. At this point, the inner piston of the upper packer may be adapted to shut-off communication from the flow bore of the upper packer. Closing communication from the flow bore of the upper packer prevents the packing element from being subjected to any excessive force by the increased pressure, while being maintained in a setting position.

The fluid is then injected at a fourth flow rate and pressure, indicated by the fracture valve opening shown on the chart at 630. At this point, the fourth flow rate and pressure has reached a magnitude sufficient enough to force the fracture valve c-ring past the tapered shoulder on the lower housing, allowing the flow diverter to release its sealed engagement with the seal sleeve, exposing the insert arrangement and ports, and directing the injected fluid into the annulus surrounding the fracture valve. After the fracture valve has begun to open, the flow rate of the injected fluid increases but the pressure in the fracture valve decreases due to the larger flow area, i.e. the opened communication between the valve and the annulus. The increased flow rate creates a pressure differential between the inside of the fracture valve and the surrounding annulus to help maintain the valve in an open position. The injected fluid is held in the annular region between the upper and lower packers.

The fluid is then injected at a fifth flow rate and pressure, indicated by the fracture valve being fully opened shown on the chart at 640. A greater volume fluid can then be injected into the wellbore so that fracturing operations can be completed. The completion of an operation can be shown in FIG. 6 by the increase and subsequent return of both the flow rate and the pressure after the valve has been fully opened.

Once the operation is complete, the assembly is adapted to reset by de-pressurization. As the assembly is de-pressurized, the inner pistons and packing pistons of the upper and lower packers are biased into their run-in positions by return spring forces. Also, the fracture valve is adapted to close at a lower pressure, the beginning of the closing shown on the chart at 650. During the closing of the fracture valve, the return spring supplies the force to allow the c-ring to radially compress as it travels up the return bevel, which is fashioned with a smaller return angle as compared to the tapered shoulder. After the c-ring is re-positioned above the tapered shoulder, the valve is fully closed and the flow diverter is sealingly engaged with the seal sleeve. The assembly may then be removed from the wellbore or directed to another location.

While the foregoing is directed to embodiments of the present invention, other and further embodiments of the invention may be devised without departing from the basic scope thereof, and the scope thereof is determined by the claims that follow.

The invention claimed is:

1. A packer for use in a wellbore, comprising:

a mandrel having a bore formed therethrough;

a packing element coupled to the mandrel;

a first piston coupled to the mandrel and operable to set the packing element by pressurization of the first piston via the mandrel bore; and a second piston disposed between the first piston and the mandrel and operable between a first position where the first piston is in fluid communication with the mandrel bore and a second position where the second piston substantially isolates fluid communication between the first piston and the mandrel bore, wherein when in the first position the packing element is unset and when in the second position the packing element is set.

2. The packer of claim 1, wherein the first piston further comprises a chamber.

3. The packer of claim 2, wherein the packer further comprises a housing having a cavity, wherein the second piston is slideably disposed within the cavity of the housing.

4. The packer of claim 3, wherein the cavity is in fluid communication with the chamber.

5. The packer of claim 4, wherein the mandrel bore is in fluid communication with the cavity.

6. The packer of claim 5, wherein the second piston is operable to substantially isolate fluid communication between the mandrel bore and the chamber.

7. The packer of claim 3, wherein the housing is disposed between the first piston and the mandrel.

8. The packer of claim 1, wherein the first piston is operable to set the packing element at a first fluid pressure.

9. The packer of claim 8, wherein the second piston is operable to substantially isolate fluid communication between the first piston and the mandrel bore at a second fluid pressure.

10. The packer of claim 9, wherein the second fluid pressure is greater than or equal to the first fluid pressure.

11. The packer of claim 10, wherein when the second piston is in the second position, the first piston maintains the set packing element.

12. A packer for use in a wellbore, comprising:

a tubular member having a bore formed therethrough;

a packing element coupled to the tubular member;

a first piston assembly coupled to the tubular member and having a first chamber, wherein the first piston assembly is operable to set the packing element, wherein the first chamber is in fluid communication with the bore of the tubular member; and a second piston assembly coupled to the tubular member and having a second chamber, wherein the second piston assembly is operable to control fluid communication between the first chamber and the bore of the tubular member by closing fluid communication through the second chamber.

13. The packer of claim 12, wherein the second chamber is in fluid communication with the bore of the tubular member.

14. The packer of claim 13, wherein the second chamber is in fluid communication with the first chamber.

15. The packer of claim 14, wherein fluid communication between the first chamber and the bore of the tubular member is provided through the second chamber.

16. The packer of claim 15, wherein the second piston assembly includes a piston member disposed within the second chamber, wherein the piston member is movable from a first position to a second position to close fluid communication between the first chamber and the bore of the tubular member.

17. The packer of claim 12, wherein fluid communication between the first chamber and the bore of the tubular member is provided through the second chamber.

18. The packer of claim 12, wherein the second piston assembly includes a piston member disposed within the second chamber, wherein the piston member is movable from a first position to a second position to close fluid communication between the first chamber and the bore of the tubular member.

19. The packer of claim 12, wherein the second piston assembly includes a piston member disposed within the second chamber, wherein the piston member is movable from a first position to a second position to close fluid communication between the first chamber and the second chamber while permitting fluid communication between the second chamber and the bore of the tubular.

20. The packer of claim 12, wherein the second piston assembly includes:

a piston member disposed within the second chamber;

a rod member coupled to the piston member; and a biasing member coupled to the rod member, wherein the biasing member is operable to bias the piston member into an open position to open fluid communication between the first chamber and the bore of the tubular member through the second chamber.

21. A method for setting a packer assembly in a wellbore, comprising:

running the packer assembly having a packing element, an actuation mechanism, and an isolation mechanism into the wellbore;

increasing fluid pressure in a flow bore to set the packing element using the actuation mechanism and to actuate the isolation mechanism to fluidly isolate the actuation mechanism from the flow bore; and increasing the fluid pressure in the flow bore, while isolating the fluid pressure from the packing element and maintaining the packing element in a set position.

22. The method of claim 21, further comprising flowing the fluid pressure from the flow bore to the actuation mechanism through a chamber of the isolation mechanism to set the packing element.

23. The method of claim 22, wherein the isolation mechanism further comprises a member disposed within the chamber, and further comprising moving the member from a first position to a second position to close fluid communication between the flow bore and the actuation mechanism while permitting fluid communication between the flow bore and the chamber.

24. The method of claim 23, further comprising biasing the member to the first position to permit fluid communication between the flow bore and the actuation mechanism.

25. The method of claim 21, further comprising preventing movement of at least one of the packing element and the actuation mechanism after the isolation mechanism is actuated.

26. The method of claim 21, wherein the fluid pressure is continuously increased in the flow bore to both set the packing element and actuate the isolation mechanism.

27. The method of claim 21, further comprising actuating the isolation mechanism to fluidly isolate the actuation mechanism from the flow bore while the packing element is in a set position.

28. A method for setting a packer assembly in a wellbore, comprising:

running the packer assembly into the wellbore, wherein the packer assembly includes a mandrel having a flow bore disposed therethrough, a packing element coupled to the mandrel, and a piston assembly coupled to the mandrel;

supplying fluid pressure through the flow bore to set the packing element; and closing fluid communication through a chamber of the piston assembly using the fluid pressure, thereby substantially isolating fluid communication between the packing element and the flow bore while the packing element is in a set position.

29. The method of claim 28, further comprising supplying the fluid pressure through the flow bore at a first pressure to begin setting of the packing element.

30. The method of claim 29, further comprising increasing the fluid pressure from the first pressure to a second pressure to actuate the piston assembly, thereby closing fluid communication through the chamber of the piston assembly.

31. The method of claim 28, further comprising increasing the fluid pressure in the flow bore, while isolating the fluid pressure from the packing element and maintaining the packing element in the set position.

32. The method of claim 28, further comprising preventing movement of the packing element after substantially isolating fluid communication between the packing element and the flow bore.

33. The method of claim 28, further comprising continuously supplying the fluid pressure through the flow bore to both set the packing element and close fluid communication through the chamber of the piston assembly.

34. A packer for use in a wellbore, comprising:

a mandrel having a bore formed therethrough;

a packer assembly coupled to the mandrel; and a piston assembly coupled to the mandrel and having a chamber and a piston member disposed within the chamber, wherein the piston member is movable between a first position where the packer assembly is in fluid communication with the bore through the chamber and a second position where the packer assembly is substantially isolated from fluid communication with the bore while the packer assembly is in a set position.

* * * * *